US007901151B2

(12) United States Patent
Sato et al.

(10) Patent No.: US 7,901,151 B2
(45) Date of Patent: Mar. 8, 2011

(54) PLATEN ROLLER AND RECORDING DEVICE AND STICKING LABEL PRINTER PROVIDED WITH PLATEN ROLLER

(75) Inventors: Yoshinori Sato, Chiba (JP); Masanori Takahashi, Chiba (JP); Hiroyuki Kohira, Chiba (JP); Tatsuya Obuchi, Chiba (JP); Minoru Hoshino, Chiba (JP)

(73) Assignee: Seiko Instruments Inc. (JP)

( * ) Notice: Subject to any disclaimer, the term of this patent is extended or adjusted under 35 U.S.C. 154(b) by 792 days.

(21) Appl. No.: 11/338,102

(22) Filed: Jan. 24, 2006

(65) Prior Publication Data

US 2006/0164503 A1 Jul. 27, 2006

(30) Foreign Application Priority Data

Jan. 26, 2005 (JP) ..... 2005-018351

(51) Int. Cl.
*B41J 11/04* (2006.01)
*B41J 11/057* (2006.01)

(52) U.S. Cl. ..... 400/659; 400/648; 347/220

(58) Field of Classification Search ..... 400/648, 400/659

See application file for complete search history.

(56) References Cited

U.S. PATENT DOCUMENTS

| | | | | |
|---|---|---|---|---|
| 1,963,856 | A | 6/1934 | Lewis et al. | |
| 5,846,358 | A * | 12/1998 | Nagamoto et al. | 156/64 |
| 6,163,675 | A * | 12/2000 | Kido et al. | 399/313 |
| 6,281,166 | B1 * | 8/2001 | Kronzer | 503/227 |
| 2002/0064613 | A1 * | 5/2002 | Kugo et al. | 428/35.2 |
| 2003/0117479 | A1 | 6/2003 | Ichikawa et al. | |
| 2004/0163556 | A1 * | 8/2004 | Kugo et al. | 101/226 |
| 2005/0078986 | A1 * | 4/2005 | Nakamura et al. | 399/286 |

FOREIGN PATENT DOCUMENTS

| | | | |
|---|---|---|---|
| EP | 0280241 | A2 | 8/1988 |
| EP | 0788972 | A1 | 8/1997 |
| EP | 1440888 | A1 | 7/2004 |
| JP | 01116671 | A * | 5/1989 |
| JP | 08132794 | A * | 5/1996 |
| JP | 2004174968 | A * | 6/2004 |
| JP | 2004175001 | A * | 6/2004 |

* cited by examiner

*Primary Examiner* — Daniel J Colilla
(74) *Attorney, Agent, or Firm* — Adams & Wilks

(57) ABSTRACT

A platen roller is provided for conveying a thermally active adhesive sheet having a recordable surface formed on one side of a sheet-like substrate and a thermally active adhesive layer formed on the other side of the sheet-like substrate. The platen roller comprises a roller portion containing a compound suitable for use as a solid plasticizer in the thermally active adhesive layer of the thermally active adhesive sheet.

13 Claims, 2 Drawing Sheets

PLATEN ROLLER AND RECORDING DEVICE AND STICKING LABEL PRINTER PROVIDED WITH PLATEN ROLLER

BACKGROUND OF THE INVENTION

1. Field of the Invention

The present invention relates to a platen roller for conveying a thermally active adhesive sheet having a thermally active adhesive layer on a back-surface side of a recording surface of a sheet-like substrate, a method of manufacturing the platen roller, and a recording device and a sticking label printer which are provided with the platen roller.

2. Description of the Related Art

Heretofore, in many cases, a sticking label such as a POS label for foods, a physical distribution and delivery label, a medical label, a baggage tag, and a display label for bottles and cans is supplied in a tentatively bonded state in which a pressure-sensitive adhesive layer is disposed on a backside of a recording surface (printing surface), and separate paper (separator) is attached onto the layer. Moreover, after printing a predetermined barcode, price or the like on the recording surface, the sticking label is peeled from the separate paper, and attached for use. However, after this type of sticking label is used, the separate paper remains, and there is a problem that a waste is generated.

To solve the problem, there has been investigated utilization of a thermally active adhesive sheet having a thermally active adhesive layer on a backside of a recording surface of a sheet-like substrate as the sticking label which does not generate any waste after use. The thermally active adhesive layer is formed of a material which does not have any adhesive property approximately at room temperature but which is thermally activated to develop the adhesive property when heated at, for example, about 50 to 150° C. The material forming the thermally active adhesive layer is constituted of a heat-sensitive adhesive material containing main components such as a thermoplastic resin and a solid plasticizer as disclosed in, for example, Patent Documents (Japanese Patent Application Laid-Open No. 10-140117, Japanese Patent Application Laid-Open No. 2002-105414, Japanese Patent Application Laid-Open No. 2002-114953, Japanese Patent Application Laid-Open No. 2002-114954, Japanese Patent Application Laid-Open No. 2002-114955, Japanese Patent Application Laid-Open No. 11-79152). When the solid plasticizer is heated and molten, the adhesive property is imparted to the thermoplastic resin. Since the molten solid plasticizer is brought into an overcooled state and gradually crystallized, the adhesive property is sustained for a predetermined time. While the sticking label has this adhesive property, the label can be attached to an object such as a glass bottle.

As thermal activation means for thermally activating the thermally active adhesive layer of such thermally active adhesive sheet, there are considered applications of various heating systems such as a system using a heating roll, a hot air spraying system, an infrared radiation system, and a system using an electrothermal heater or a dielectric coil. In Patent Document 6, there is disclosed a technology in which a thermal head is used as the thermal activation means. The thermal head is broadly utilized as a recording thermal head of a thermal printer, and has a plurality of resistors (heating elements) disposed on a ceramic substrate as heat sources. The thermal head is brought into contact with the thermally active adhesive layer of the thermally active adhesive sheet to heat the layer.

Here, FIG. 1 shows a schematic diagram of a general constitution of a sticking label printer in which the thermal head is used as recording means for recording information on a recording surface and thermal activation means for thermally activating the thermally active adhesive layer. This sticking label printer is provided with a recording device 1, a thermal activation device 2, and a cutter unit 3. Moreover, when a thermally active adhesive sheet 4 wound into a roll shape is introduced into this sticking label printer, predetermined recording is performed on the recording surface of the thermally active adhesive sheet 4 by means of a recording thermal head 11 of the recording device 1, the thermally active adhesive sheet 4 is cut into an appropriate size by the cutter unit 3, the thermally active adhesive layer of the thermally active adhesive sheet 4 is thermally activated by a thermally activating thermal head 21 of the thermal activation device 2, and a targeted sticking label is discharged. This series of treatment is performed while the thermally active adhesive sheet 4 is conveyed by rollers such as appropriately disposed platen rollers. A dimethyl silicone rubber having a low compressive permanent set property is generally used as a material forming a roller portion of the platen roller.

However, in a case where the thermally active adhesive sheet is subjected to the recording and the thermal activating by the above-described sticking label printer, an adhesive force of the thermally active adhesive layer of the discharged thermally active adhesive sheet weakens or disappears depending on a place.

SUMMARY OF THE INVENTION

An object of the present invention is to provide a platen roller capable of inhibiting drop of an adhesive force of a thermally active adhesive layer, which is seen in a case where recording and thermal activating are performed with respect to a thermally active adhesive sheet having the thermally active adhesive layer on a backside of a recording surface of a sheet-like substrate, a method of manufacturing the platen roller, and a recording device and a sticking label printer which are provided with the platen rollers.

According to the present invention, there is provided a method of manufacturing a platen roller for conveying a thermally active adhesive sheet having a thermally active adhesive layer on a backside of a recording surface of a sheet-like substrate, the method comprising the step of:

performing a contact treatment to bring the surface of a roller portion of the platen roller into contact with a compound (a) containable as a solid plasticizer in the thermally active adhesive layer.

Moreover, according to the present invention, there is provided a platen roller for conveying a thermally active adhesive sheet having a thermally active adhesive layer on a backside of a recording surface of a sheet-like substrate, wherein a contact treatment is performed to bring the surface of a roller portion into contact with a compound (a) containable as a solid plasticizer in the thermally active adhesive layer.

Furthermore, according to the present invention, there is provided a recording device comprising: recording means for recording on a recording surface of a thermally active adhesive sheet having a thermally active adhesive layer on a backside of the recording surface of a sheet-like substrate; and the above-described platen roller of the present invention.

Additionally, according to the present invention, there is provided a sticking label printer which records information on a recording surface of a thermally active adhesive sheet having a thermally active adhesive layer on a backside of the recording surface of a sheet-like substrate and which thermally activates the thermally active adhesive layer to make a sticking label, the printer comprising:

recording means for the recording on the recording surface; thermal activation means for thermally activating the thermally active adhesive layer; and the above-described platen roller of the present invention.

According to the present invention, it is possible to inhibit drop of an adhesive force of a thermally active adhesive layer, which is seen in a case where recording and thermal activating are performed with respect to a thermally active adhesive sheet having the thermally active adhesive layer on a backside of a recording surface of a sheet-like substrate. The surface of a platen roller usually for use may be subjected to simple treatment, and a material forming a roller portion of the platen roller does not have to be reviewed. Therefore, there can be provided a method of manufacturing a platen roller which is capable of suppressing a material cost rise and which is superior in productivity.

DETAILED DESCRIPTION OF THE PREFERRED EMBODIMENT

[Platen Roller and Method of Manufacturing the Platen Roller]

A platen roller of the present invention is used for conveying a thermally active adhesive sheet having a thermally active adhesive layer on a backside of a recording surface of a sheet-like substrate. Especially, the platen roller is suitable as a platen roller disposed while brought into contact under pressure with recording means for recording information on the recording surface of the thermally active adhesive sheet, especially a recording thermal head. The thermally active adhesive sheet to be conveyed may be subjected to recording such as printing, or the sheet may be before subjected to recording such as the printing.

Figure 2:
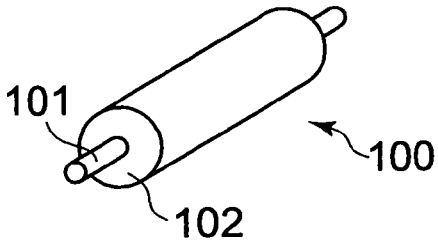
FIG. 2 is a perspective view showing a constitution of a platen roller.

For example, as shown in FIG. 2, the platen roller 100 is constituted of a shaft core member 101, and a roller portion 102 disposed on an outer periphery of the shaft core member 101.

As the shaft core member 101, there can be used a member which functions as a support member of the roller portion 102 of a platen roller 100 and which is rotatable by a power of a driving system. The shaft core member 101 is made of: a metal such as iron, aluminum, titanium, copper, or nickel; an alloy such as stainless steel, duralumin, brass, or bronze; a resin such as tetrafluoroethylene or polyethylene terephthalate; a composite material of carbon black or carbon fiber and resin; or the like. The shaft core member 101 may have a columnar shape, or a cylindrical shape whose central portion is hollow.

In a recording device, a thermal activation device, a sticking label printer or the like provided with the platen roller, the platen roller 100 is disposed while brought into contact under pressure with the thermal head, another roller or the like, and has a function of conveying a sheet sandwiched between them. As a material which has heretofore formed the roller portion 102 of the platen roller 100, there is generally used a dimethyl silicone rubber having a low compressive permanent set property.

Examples of the rubber component include: diene-based rubbers such as a natural rubber (NR), a styrene butadiene rubber (SBR), a butadiene rubber (BR), a nitrile rubber (NBR), an isoprene rubber (IR), and a chloroprene rubber (CR); and non-diene-based rubbers such as a butyl rubber (IIR), an ethylene propylene rubber (EP, EPDM, EPM), a chlorosulfonated rubber (CSM), an acryl rubber (ACM), an urethane rubber (U), a silicone rubber (Q), a fluorosilicone rubber (FVMQ or the like), copolymer fluorosilicone rubber, and a fluorine rubber (FM, FEPM, FFKM or the like). Above all, non-diene-based rubbers are preferable such as the butyl rubber, the ethylene propylene rubber, the chlorosulfonated rubber, the acryl rubber, the urethane rubber, the silicone rubber, the fluorosilicone rubber, the copolymer fluorosilicone rubber, and the fluorine rubber. The butyl rubber, the ethylene propylene rubber, the acryl rubber, the silicone rubber, the fluorosilicone rubber, the copolymer fluorosilicone rubber, or the fluorine rubber is more preferable because it is superior in heat resistance. The silicone rubber, the fluorosilicone rubber, the copolymer fluorosilicone rubber, or the fluorine rubber is especially preferable, and the silicone rubber is most preferable, because it has a strong trap force of a compound (a) which can be contained as the solid plasticizer in the thermally active adhesive layer as described later. As the rubber component, one type may be used, or two or more types may be appropriately combined and used.

In addition, if necessary, an appropriate amount of a vulcanizing agent, a flame retardant, a coloring agent, an ultraviolet absorber, an anti-aging agent, an oxidation inhibitor, a conductivity imparting agent or the like may be blended in the material constituting the roller portion of the platen roller of the present invention.

A method of forming the roller portion of the platen roller of the present invention can be appropriately selected depending on a type of material forming the roller portion. For example, there is: a method of disposing beforehand a shaft core member in a molding mold to inject a material forming the roller portion into the mold; and a method of molding the material forming the roller portion beforehand into a roller portion shape, and thereafter inserting the shaft core member whose surface is provided with a bonding layer to bond the member or the like. A diameter of the platen roller, or a length thereof in a longitudinal direction can be appropriately set in accordance with a device or the like in which the platen roller is to be installed.

It is to be noted that the platen roller of the present invention is not limited to the above-described constitution, and may have, for example, a constitution having the bonding layer or the like between the shaft core member and the roller portion, a constitution of the roller portion only without disposing any shaft core member, a constitution in which the roller portion has a multilayered structure or the like.

As properties of the roller portion of the platen roller, usually, a compressive permanent set property, rubber hardness, rebound resiliency and the like are important. As to these properties, there are demanded a cold resistance (changes of the respective properties are small, e.g., when the material is left to stand at 0° C.), a heat resistance (changes of the respective properties are small, e.g., when the material is left to stand at 200° C.), and a chemical resistance (changes of the respective properties are small, e.g., when the material is left to stand in oil). In the present invention, these properties can be adjusted by a material, a method or the like for forming the roller portion of the platen roller. For example, it is preferable to appropriately select the material or the method for forming the roller portion of the platen roller in such a manner that the compressive permanent set (180° C./22 h, JIS K6262) of the roller portion is about 3 to 30%, the rubber hardness (JIS K6253, durometer A hardness) is about 30 to 60 degrees, and the rebound resiliency (JIS K6255) is about 20 to 80%.

Moreover, in the present invention, the surface of the roller portion of the platen roller formed as described above is brought into contact with the compound (a) which can be contained as the solid plasticizer in the thermally active adhesive layer of the thermally active adhesive sheet. As such compound (a), a compound may be appropriately selected which can impart an adhesive property to a thermoplastic resin contained in the thermally active adhesive layer, when molten at a desired temperature (e.g., about 50 to 150° C.). Examples include a benzotriazole-based compound, a hindered phenol-based compound, an aromatic sulfone amide compound, and a phthalic compound. The compound (a) may be used alone, or a mixture of two or more types may be used. Especially, when the benzotriazole-based compound is used, the effects of the present invention are great.

The benzotriazole-based compound refers to benzotriazole or a benzotriazole derivative, and benzotriazole is a compound represented by the following formula (I):

(I)

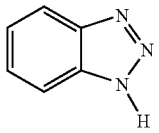

The benzotriazole derivative is a compound in which at least one of hydrogen atoms of benzotriazole is replaced with another substituent. Examples include methyl benzotriazole in which the hydrogen atom is replaced with a methyl group, carboxybenzotriazole in which the hydrogen atom is replaced with a carboxy group, nitrobenzotriazole in which the hydrogen atom is replaced with a nitro group, hydroxylbenzotriazole in which the hydrogen atom is replaced with a hydroxyl group, aminobenzotriazole in which the hydrogen atom is replaced with an amino group, and chlorobenzotriazole in which the hydrogen atom is replaced with a chlorine atom. The examples also include a compound constituted by coupling a second nitrogen atom of benzotriazole to substituent R and represented by the following formula (II) having the following structure unit, and a compound constituted by replacing at least one of the hydrogen atoms with another substituent (methyl group, carboxy group, nitro group, hydroxyl group, amino group, chlorine atom or the like) described above.

(II)

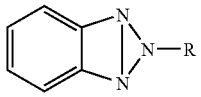

For example, as a compound in which one of the hydrogen atoms of the compound represented by the above formula (II) is replaced with the chlorine atom, there is the following (IIa).

(IIa)

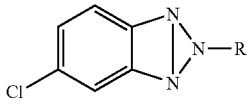

In the above (II), R is arbitrary, but the substituent represented by the following formula (III) or (IV) is preferable from a viewpoint of a melting point or a handling property.

(III)

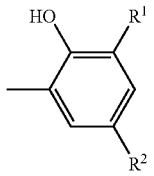

(IV)

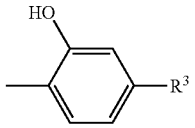

The above $R^1$, $R^2$, and $R^3$ are independent substituents selected from the hydrogen atom, an alkyl group having 1 to 22 carbon atoms, an alkenyl group having 1 to 22 carbon atoms, and an alkoxy group including the groups. The above $R^1$, $R^2$, and $R^3$ are more preferably independent alkyl groups having 1 to 12 carbon atoms, most preferably independent alkyl groups having 1 to 8 carbon atoms. The alkyl group, the alkenyl group, and the alkoxy group including these groups may have a straight chain structure, a branched-chain structure, or a cyclic structure.

Examples of the above-described contact treatment include: a treatment in which the roller portion is buried in a powder of the compound (a); and a treatment in which the roller portion is immersed into a solution of the dissolved compound (a).

As a solvent for use in the treatment to immerse the roller portion into the solution in which the compound (a) is dissolved, the solvent can be appropriately selected from solvents capable of dissolving the compound (a) for use. For example, the solvent can be selected from: alcohols such as methanol and ethanol; ketones such as acetone and methyl isobutyl ketone; fatty acid esters such as ethyl acetate and butyl acetate; aliphatic hydrocarbons such as hexane and petroleum ether; halogenated hydrocarbons such as methylene chloride and chloroform; aromatic hydrocarbons such as toluene and xylene; ethers such as diethyl ether and tetrahydrofuran and the like. The solvent is preferably selected from the solvents which do not easily swell the material forming the roller portion. For example, the solvent is preferably selected from the alcohols. A concentration of the above-described solution can be set to, for example, 10 to 70% by mass.

A time and a temperature for performing the above-described treatment can be appropriately set so as to develop the effects of the present invention.

Moreover, in another embodiment, the roller portion of the platen roller is formed of a roller portion forming material to which the above-described compound (a) has been added beforehand in addition to the above-described rubber component, and, if necessary, the appropriate amount of the blended vulcanizing agent, flame retardant, coloring agent, ultraviolet absorber, anti-aging agent, oxidation inhibitor, conductivity imparting agent or the like. Even in this case, effects similar to those of the present invention can be obtained. A blend amount of the compound (a) at this time can be appropriately set so as to develop the effects of the present invention.

[Recording Device and Sticking Label Printer]

In the present invention, a recording device is a device for recording with respect to a thermally active adhesive sheet having a thermally active adhesive layer on a backside of a recording surface of a sheet-like substrate. The device is provided with the platen roller of the present invention as a platen roller for conveying the thermally active adhesive sheet. As a typical constitution of the recording device, the device includes recording means for recording information on the recording surface of the thermally active adhesive sheet and the platen roller of the present invention. In the recording device in which the platen roller of the present invention is disposed while brought into contact under pressure with the recording means, effects of the present invention are great.

The recording device of the present invention is preferably usable as a recording device constituting a sticking label printer described later.

In the present invention, the sticking label printer performs recording and thermal activating with respect to the thermally active adhesive sheet having the thermally active adhesive layer on the backside of the recording surface of the sheet-like substrate to make a sticking label, and the printer is provided with the platen roller of the present invention. As a typical constitution of the sticking label printer, the printer includes: recording means for recording the information on the recording surface of the thermally active adhesive sheet; thermal activation means for thermally activating the thermally active adhesive layer of the thermally active adhesive sheet; and the platen roller of the present invention. In a case where the platen roller of the present invention is disposed while brought into contact under pressure with the recording means or the thermal activation means, the effects of the present invention are great.

Figure 1:
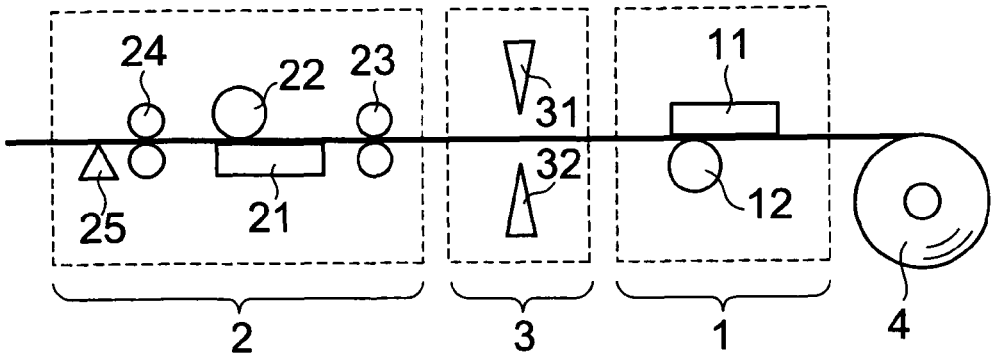
FIG. 1 is a schematic diagram showing a general constitution of a sticking label printer which performs recording and thermal activating with respect to a thermally active adhesive sheet to make a sticking label.

Typical constitution examples of the recording device and the sticking label printer of the present invention will be described hereinafter. FIG. 1 is a diagram showing a schematic constitution of the sticking label printer utilizing a system to perform the recording and the thermal activating by use of a thermal head. This sticking label printer includes: a recording device 1 which subjects the recording surface of a thermally active adhesive sheet 4 to predetermined recording; a thermal activation device 2 which heats the thermally active adhesive layer of the thermally active adhesive sheet 4 to develop an adhesive property; and a cutter unit 3 which is disposed between these devices and which cuts the thermally active adhesive sheet 4.

In the sticking label printer of FIG. 1, the recording device 1 includes: a recording thermal head 11 as recording means for the recording on the recording surface of the thermally active adhesive sheet 4; and a platen roller 12. The platen roller 12 is disposed while brought into contact under pressure with the recording thermal head 11 by pressurizing means (not shown), and the thermally active adhesive sheet 4 is pressed and held between the roller and the head. When the platen roller 12 is rotated (counterclockwise in FIG. 1) by a driving system (not shown), the thermally active adhesive sheet 4 is drawn from the roller and conveyed. At this time, a rotation speed of the platen roller 12 is controlled based on a recording signal from a recording control unit (not shown), and the recording thermal head 11 is operated. Accordingly, the recording surface of the thermally active adhesive sheet 4 is subjected to the desired recording.

It is to be noted that a recording system in the recording device 1 is a heat-sensitive system, but a system other than the heat-sensitive system may be used as long as it is possible to perform the desired recording on the recording surface of the thermally active adhesive sheet. For example, a thermal transfer system, an ink jet system, an electrophotographic system or the like may be used. In this case, the recording device 1 may be constituted of the recording means required for the recording by the corresponding system, and the platen roller of the present invention. In the recording device having the recording means of the heat-sensitive system or the thermal transfer system, the effects of the present invention are great. In the recording device having the recording means of the heat-sensitive system, the effects of the present invention are greater.

The thermally active adhesive sheet 4 subjected to the desired recording in the recording device of the sticking label printer of FIG. 1 is conveyed to the cutter unit 3. In the sticking label printer, the cutter unit 3 includes a movable blade 31 and a fixed blade 32 as cutting means. The movable blade 31 is operable at a predetermined timing by a cutting control unit and a driving source (either is not shown), and is capable of cutting the thermally active adhesive sheet 4 into an appropriate length.

It is to be noted that the cutter unit 3 can be formed into a constitution other than the above-described constitution as long as the thermally active adhesive sheet 4 can be cut into the appropriate length. For example, the cutter unit may be constituted of two movable blades. The cutter unit 3 may be disposed between the recording device 1 and the thermal activation device 2 as described above, or may be installed in a portion through which the thermally active adhesive sheet 4 passes before the recording device 1 or after the thermal activation device 2.

The thermally active adhesive sheet 4 cut into the appropriate length by the cutter unit of the sticking label printer of FIG. 1 is next conveyed into the thermal activation device 2 by means of insertion rollers 23 of the thermal activation device 2. The thermal activation device 2 includes: a thermally activating thermal head 21 as thermal activation means for thermally activating the thermally active adhesive layer of the thermally active adhesive sheet 4; and a platen roller 22 disposed while brought into contact under pressure with the thermally activating thermal head 21 by the pressurizing means (not shown). Moreover, the thermally activating thermal head 21 operates at a predetermined timing by means of a thermal activation control unit (not shown), and can heat the thermally active adhesive layer of the thermally active adhesive sheet 4 to thereby thermally activate the layer. When the platen roller 22 is rotated (clockwise in FIG. 1) by a driving system (not shown), the thermally active adhesive sheet 4 is conveyed, and the sticking label is discharged to the outside via discharging rollers 24. It is detected by a discharge detecting sensor 25 that the sticking label has been discharged, and treatments such as recording, cutting, and thermal activating are performed in such a manner that the next sticking label is discharged at a predetermined timing.

It is to be noted that as to a thermal activation system in the thermal activation device 2, there may be used a system other than the above-described system in which the thermally activating thermal head is brought into contact with the thermally active adhesive layer of the thermally active adhesive sheet to heat the layer, as long as the thermally active adhesive layer of the thermally active adhesive sheet can be thermally activated. For example, there may be used a system using a heating roll, a hot air spraying system, an infrared radiation system, a system using an electrothermal heater or a dielectric coil or the like. In this case, the thermal activation device 2 can be constituted of thermal activation means required for the thermal activating by the corresponding system, and the platen roller of the present invention.

Figure 3A:
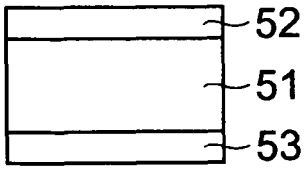
FIGS. 3A and 3B are sectional views showing embodiments of a layer constitution of the thermally active adhesive sheet for use in the sticking label printer which records information in a heat-sensitive system.
Figure 3B:
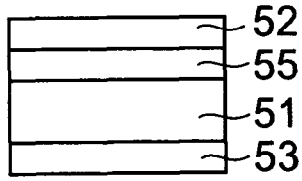

As to the thermally active adhesive sheet 4 usable in the sticking label printer in which the recording is performed with respect to the recording surface by a heat-sensitive system, and the thermally active adhesive layer is heated by the thermally activating thermal head as in the sticking label printer of FIG. 1, for example, a thermally active adhesive sheet is usable which is constituted by disposing a heat-sensitive layer 52 on the recording surface of a sheet-like substrate 51, and disposing a thermally active adhesive layer 53 on a backside of the substrate as shown in a layer constitution of FIG. 3A. Alternatively, as shown in FIG. 3B, a thermally active adhesive sheet may be used which is provided with an insulating layer 55 between the sheet-like substrate 51 and the heat-sensitive layer 52.

The thermally active adhesive layer 53 is formed of a material which does not have any adhesive property approximately at room temperature but which is thermally activated to develop the adhesive property, when heated at about 50 to 150° C. The layer is usually constituted of a heat-sensitive adhesive material containing main components such as a thermoplastic resin and a solid plasticizer as disclosed in, for example, Patent Documents 1 to 5. When the solid plasticizer is heated and molten, the adhesive property is imparted to the thermoplastic resin. Since the molten solid plasticizer is brought into an overcooled state and gradually crystallized, the adhesive property is sustained for a predetermined time. While the sticking label has this adhesive property, the label can be attached to an object such as a glass bottle.

Examples of a usable thermoplastic resin include a (meth) acrylic ester copolymer, a styrene-isoprene copolymer, a styrene-acrylic ester copolymer, a styrene-butadiene copolymer, an acrylonitrile-butadiene copolymer, an ethylene-vinyl acetate copolymer, a vinyl acetate-acrylic ester copolymer, an ethylene-polyvinyl chloride copolymer, an ethylene-acrylic ester copolymer, a vinyl acetate-ethylene-polyvinyl chloride copolymer, a vinyl acetate-ethylene-acrylic ester copolymer, a vinyl acetate-ethylene-styrene copolymer, polybutadiene, and polyurethane. A glass transition temperature of the thermoplastic resin for use is preferably −70 to 20° C., more preferably −67 to 0° C. A weight-average molecular weight of the thermoplastic resin is preferably 100,000 to 300,000.

As the solid plasticizer, a compound may be appropriately selected which is capable of imparting the adhesive property to the thermoplastic resin when molten at a desired temperature (e.g., about 50 to 150° C.). Examples include a benzotriazole-based compound, a hindered phenol-.based compound, an aromatic sulfone amide compound, and a phthalate compound. Above all, in the thermally active adhesive sheet containing the benzotriazole-based compound as the solid plasticizer, the effects of the present invention are great. In the thermally active adhesive sheet containing the benzotriazole-based compound used in subjecting the roller portion of the platen roller to the contact treatment, the effects of the present invention are especially great.

A content of the solid plasticizer in the thermally active adhesive layer can be appropriately set in such a manner as to develop a targeted thermally activated property, and the content is preferably 50 to 500 parts by mass, more preferably 100 to 400 parts by mass with respect to 100 parts by mass of the thermoplastic resin.

The thermally active adhesive layer may contain components other than the thermoplastic resin and the solid plasticizer.

The recording device of the present invention can be preferably used as a recording device constituting a sticking label printer which performs recording and thermal activating on demand as described above, but the device may be constituted of the recording device alone that does not have any thermal activation device. For example, the device may be constituted to supply a recorded thermally active adhesive sheet whose recording surface is subjected beforehand to recording such as the printing. A device may be constituted of the recording device of the present invention, and cutting means capable of cutting the thermally active adhesive sheet into a desired size. For example, the device may be constituted in such a manner that the recording surface of the thermally active adhesive sheet is subjected beforehand to recording such as the printing, and a recorded sticking label cut into a desired size is supplied.

It is to be noted that mechanisms are presumed as follows, respectively. The mechanisms can inhibit drop of an adhesive force of the thermally active adhesive layer, which is seen in a case where the recording and the thermal activating are performed with respect to the thermally active adhesive sheet having the thermally active adhesive layer on the backside of the recording surface of the sheet-like substrate, when the recording device or the sticking label printer is constituted using the platen roller of the present invention.

According to investigations by the present inventors, it has been found that when: performing the recording and the thermal activating with respect to the thermally active adhesive sheet to make the required number of sticking labels; leaving the thermally active adhesive sheet to stand (e.g., for about several hours) in a state in which the sheet is not completely used; and restarting the recording and the thermal activating of the thermally active adhesive sheet in order to make the sticking labels, the adhesive force of the thermally active adhesive layer easily drops. That is, the following cause has been considered: when the platen roller of the recording device and the thermally active adhesive layer are held while pressed in the state in which the recording and the thermal activating are stopped, the thermally active adhesive layer of the thermally active adhesive sheet and the platen roller interact, and the adhesive force of the thermally active adhesive layer drops. As this interaction, it is supposed that the solid plasticizer contained in the thermally active adhesive layer moves toward the platen roller. Moreover, as in the present invention, the surface of the roller portion is brought into contact with the compound (a) which can be contained as the solid plasticizer in the thermally active adhesive layer. Accordingly, the compound (a) enters the roller portion of the platen roller and is trapped, and the solid plasticizer contained in the thermally active adhesive layer of the thermally active adhesive sheet does not easily move toward the platen roller. As a result, the drop of the adhesive force of the thermally active adhesive layer can be inhibited.

Here, a principle by which the compound (a) is trapped as described above will be presumed as follows. In general, a rubber material has a large distance between molecules owing to its property (therefore, the material is soft), and a low-molecular organic compound easily enter the material. It is presumed that a compound having a melting point of about 50° C. to 130° C. like the compound (a) containable as the solid plasticizer in the thermally active adhesive layer is partially dissolved and liberated by a certain degree of pressure, the rubber material is impregnated with the compound, and the compound is again solidified and stabilized in the rubber. On the other hand, it is supposed that the rubber material is impregnated with a low-melting material such as an organic solvent, but the material thereafter oozes to the surface. It is supposed that since a high-melting material is not dissolved only by the pressure, the rubber material is not impregnated. Therefore, a compound having a best melting temperature range like the compound (a) containable as the solid plasticizer in the thermally active adhesive layer is supposed to have a high trapped property in the rubber material. When such compound (a) is trapped beforehand in the rubber material, the solid plasticizer contained in the thermally active adhesive layer of the thermally active adhesive sheet can be prevented from being liberated.

EXAMPLES

The present invention will be described specifically hereinafter in accordance with experiment examples.

[Preparation of Thermally Active Adhesive Sheet]

As a solid plasticizer, 100 parts by mass of 2-[5'-(1",1",3–,3"-tetramethyl butyl)-2'-hydroxyphenyl]benzotriazole (melting point at 103° C., hereinafter referred to as the compound (i)) represented by the following formula (i) were blended with 5 parts by mass of sodium salt of polyacrylic acid as a dispersant (manufactured by Toagosei Co., Ltd., trade name: Alon T-40), and water was added in such a manner that a solid content concentration of the compound (i) was 50% by mass. This mixture was wet-crushed using a ball mill type crusher until an average grain size reached 2 μm, and a solid plasticizer dispersion liquid was obtained.

(i)

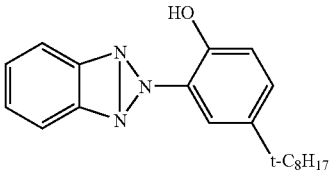

Moreover, 180 parts by mass of this solid plasticizer dispersion liquid were mixed with 100 parts by mass of vinyl acetate-ethylene-acrylic copolymer emulsion as a thermoplastic resin (manufactured by Sumitomo Chemical Co., Ltd., trade name: Sumica Flex 910) and 100 parts by mass of a rosin ester dispersion liquid as an adhesive property imparting agent (manufactured by Arakawa Kagaku Kogyo Kabushiki Kaisha, trade name: Super Ester E-730), and a dispersion liquid for forming a thermally active-adhesive layer, having a solid content concentration of 50% by mass, was obtained.

Furthermore, a back surface of a heat-sensitive sheet (mass of a sheet-like substrate: 100 g/m$^2$, mass of an insulating layer: 5 g/m$^2$, mass of a heat-sensitive layer: 5 g/m$^2$) whose one surface was provided with the insulating layer and the heat-sensitive layer was coated with the dispersion liquid for forming the thermally active adhesive layer obtained as described above, and dried so that a dry mass was 25 g/m$^2$. The thermally active adhesive layer was formed, and a thermally active adhesive sheet was obtained.

[Preparation of Platen Roller]

A shaft core member made of stainless steel was set in a platen roller molding mold, and a material of a silicone rubber mixed (manufactured by Asahi Chemical Industry Wacker Co., Ltd., trade name: EL5307F) mixed and kneaded with a vulcanizing agent was pressurized on an outer periphery of the member to form a roller portion. Molding conditions (primary vulcanization) were set to 165° C./10 minutes. Thereafter, a molded article was taken out of the mold, and subjected to secondary vulcanization on conditions of 200° C./4 hours in a baking furnace.

Furthermore, the surface of the roller portion was brought into contact with a benzotriazole-based compound as a compound (a) containable as a solid plasticizer in the thermally active adhesive layer. As the benzotriazole-based compound, there were used the compound (i) used as the solid plasticizer contained in the thermally active adhesive layer of the thermally active adhesive sheet and/or carboxybenzotriazole [manufactured by Daiwa Kasei K. K., hereinafter referred to as the compound (ii)] represented by the following formula (ii).

(ii)

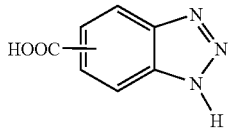

To be more specific, the material was subjected to a treatment (experiment Nos. 1 and 2) in which the material was buried in a powder of the compound (i) or (ii); a treatment (experiment No. 3) in which the material was buried in a powder of the mixed compounds (i) and (ii) having an equal mass; and a treatment (experiment No. 4) in which the material was immersed into 50% by mass of ethanol solution of the mixed compounds (i) and (ii) having the equal mass to prepare a platen roller. The platen roller was used in the following test together with a platen roller as a comparative example which was not subjected to the above-described contact treatment.

[Adhesive Strength Disappearance Resistance Test]

Figure 4:
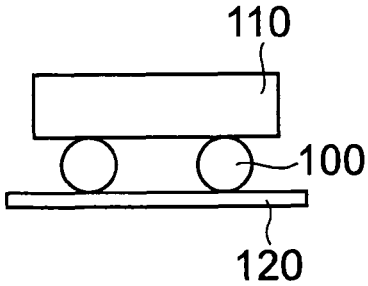
FIG. 4 is a diagram showing a state at a time when the thermally active adhesive sheet is pretreated in an adhesive strength disappearance test.

First, the thermally active adhesive sheet was subjected to the following pretreatment. As shown by a state at a pretreatment time in FIG. 4, two platen rollers 100 were disposed on the thermally active adhesive layer of a thermally active adhesive sheet 120, and a weight 110 was laid on the rollers to apply a load of 1.2 kgf (11.8 N), and the sheet was left to stand in this state for one week.

Moreover, the pretreated thermally active adhesive layer surface was observed with a microscope.

Figure 5:
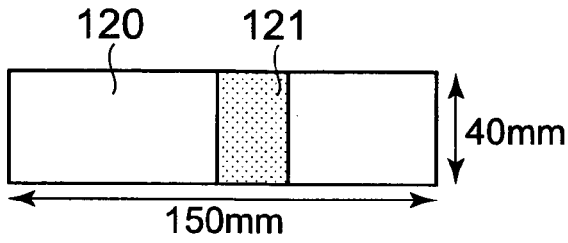
FIG. 5 is a top plan view of the thermally active adhesive sheet to be tested after the pretreatment.

Furthermore, the thermally active adhesive sheet 120 was set in such a manner that a direction vertical to a contact portion 121 of a roller portion of the platen roller was a length direction as shown in a top plan view of FIG. 5, and the sheet was cut into a length of 150 mm×a width of 40 mm. Thereafter, the thermally activate layer of the thermally active adhesive sheet was thermally activated. The thermal activation was performed by means of a thermally activating thermal head, and detailed conditions were set as follows:

all dots were energized;

there was heat history correction (control to cancel a heating member portion surface temperature rise due to accumulated heat);

activating energy: 0.28 mJ/dot (heating member resistance value: 800 Ω);

one dot size: 0.125 mm×0.125 mm;

pressing force with respect to a thermal head: 20 gf/mm (1.96 N/m);

sheet feeding speed: 100 mm/sec;

two-division driving (driving method of dividing a heating member array into two areas, successively allowing members to generate heat, and reducing an increase of a power capacity, instead of heating the whole heating member array once); and

26° C., 60% RH.

On the other hand, a member to be attached was prepared by attaching a polyolefin wrap (manufactured by Mitsubishi Plastics Inc., trade name: Dia Wrap Super) to a measurement base made of SUS by use of a double-faced adhesive tape (manufactured by Dainippon Ink & Chemicals, Inc., trade name: #8103D).

Figure 6:
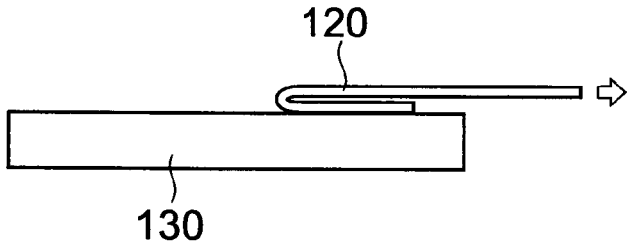
FIG. 6 is a diagram showing a state at a time when an adhesive strength of the thermally active adhesive sheet is measured.

Moreover, the thermally active adhesive sheet was laid on the member to be attached in such a manner that the thermally active adhesive layer of the thermally active adhesive sheet subjected to the thermal activation turned on the side of the member to be attached, and the sheet was pressurized twice by moving a 2 kgf (19.6 N) pressurizing roller inwardly from the front. Thereafter, end portions of the thermally active adhesive sheet were fixed to an adhesive strength measurement unit (digital force gauge, manufactured by Imada Co., trade name: DPX-5TR) via clips, and a load at a time when the sheet was pulled in a direction of 180 degrees at a speed of 300 mm/min was measured at an interval of 0.5 second (see FIG. 6).

Figure 7:
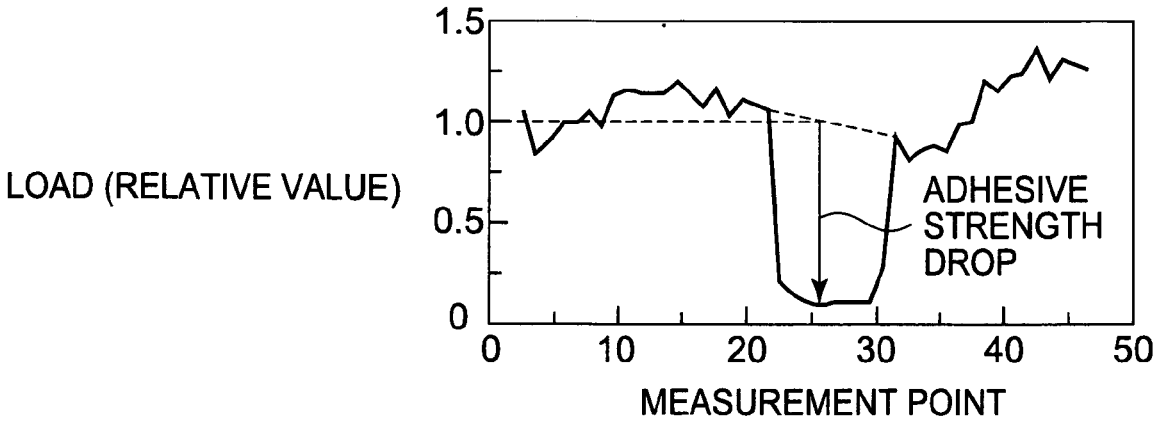
FIG. 7 is a diagram showing one example of an adhesive strength measurement result of the thermally active adhesive sheet.

As shown by one example of the measurement result of FIG. 7, there was seen a tendency that the load decreased in a place corresponding to a contact portion with the roller portion of the platen roller, and a strength drop ratio was estimated.

Various platen rollers were investigated as described above, and an adhesive property disappearance resistance was evaluated by use of the following standards based on the state of the resultant thermally active adhesive layer surface and the drop ratio of the adhesive strength. The results are shown in Table 1.

"○": The drop of the adhesive strength was less than 50%,. and there Was not any change in the state of the thermally active adhesive layer.

"x": The drop of the adhesive strength was 50% or more, or unevenness was seen on the surface of the thermally active adhesive layer.

TABLE 1

| Experiment No. | Benzotriazole derivative | Contact treatment method | Adhesive property disappearance resistance |
|---|---|---|---|
| 1 | Compound (i) | Buried in powder | ○ |
| 2 | Compound (ii) | Buried in powder | ○ |
| 3 | Compounds (i) + (ii) [mass ratio 1:1] | Buried in powder | ○ |
| 4 | Compounds(i) + (ii) [mass ratio 1:1] | Immersed in 50 mass % methanol solution | ○ |
| 5 | — | No contact treatment | X |

As described above, as to the platen roller subjected to the contact treatment to bring the surface of the roller portion into contact-with the benzotriazole-based compound which was the compound (a) containable as the solid plasticizer in the thermally active adhesive layer, an adhesive property disappearance resistance was high. That is, it is seen that the drop of the adhesive force of the thermally active adhesive layer can be inhibited by use of the platen roller subjected to the contact treatment.

What is claimed is:

1. A platen roller for conveying a thermally active adhesive sheet having a recordable surface formed on one side of a sheet-like substrate and a thermally active adhesive layer formed on the other side of the sheet-like substrate while coming in contact with the thermally active adhesive layer, the platen roller having a roller portion containing a benzotriazole-based compound that is suitable for use as a solid plasticizer in the thermally active adhesive layer of the thermally active adhesive sheet and that is trapped within the roller portion by a contact treatment which brings the surface of the roller portion into contact with the benzotriazole-based compound, the benzotriazole-based compound contained in the roller portion being present in an amount effective to prevent liberation of the solid plasticizer in the thermally active adhesive layer of the thermally active adhesive sheet when the roller portion comes in contact with the thermally active adhesive layer to thereby inhibit a drop of the adhesive force of the thermally active adhesive layer.

2. A platen roller according to claim 1; wherein the roller portion contains silicone rubber.

3. A platen roller according to claim 1; wherein the platen roller is disposed to be brought into contact under pressure with recording means for recording on the recordable surface of the thermally active adhesive sheet.

4. A recording device comprising: recording means for recording on a recordable surface of a thermally active adhesive sheet, the thermally active adhesive sheet having a thermally active adhesive layer on one side of a sheet-like substrate and the recordable surface on the other side thereof; and the platen roller according to claim 1 for conveying the thermally active adhesive sheet.

5. A recording device according to claim 4; wherein the platen roller is disposed in a state in which the platen roller is brought into contact under pressure with the recording means.

6. A recording device according to claim 5; wherein the recording means comprises a recording thermal head.

7. A sticking label printer for generating a sticking label comprised of a thermally active adhesive sheet having a thermally active adhesive layer formed on one side of a sheet-like substrate and a recordable surface formed on the other side thereof, the printer comprising:

recording means for recording on the recordable surface of the thermally active adhesive sheet;

thermal activation means for thermally activating the thermally active adhesive layer of the thermally active adhesive sheet; and the platen roller according to claim 1 for conveying the thermally active adhesive sheet.

8. A sticking label printer according to claim 7; wherein the platen roller is disposed in a state in which the platen roller is brought into contact under pressure with the recording means.

9. A sticking label printer according to claim 8; wherein the recording means comprises a recording thermal head.

10. In combination: a thermally active adhesive sheet having a recordable surface formed on one side of a substrate and a thermally active adhesive layer that contains a solid plasticizer formed on the other side of the substrate; and a platen roller for conveying the thermally active adhesive sheet while contacting the thermally active adhesive layer, the platen roller having a roller portion that contains a compound which is the same as the solid plasticizer contained in the thermally active adhesive layer and which is present in an amount effective to prevent liberation of the solid plasticizer from the thermally active adhesive layer while the thermally active adhesive layer is in contact with the roller portion to thereby inhibit a drop of the adhesive force of the thermally active adhesive layer.

11. A combination according to claim 10; wherein the solid plasticizer contained in the thermally active adhesive layer and the compound contained in the roller portion comprise a benzotriazole-based compound.

12. A combination according to claim 11; wherein the roller portion further includes, in addition to the compound, a flame retardant.

13. A combination according to claim 10; wherein the roller portion further includes, in addition to the compound, a flame retardant.

* * * * *